US010371424B2

(12) United States Patent
Kugimoto et al.

(10) Patent No.: US 10,371,424 B2
(45) Date of Patent: Aug. 6, 2019

(54) THERMAL TRANSPIRATION FLOW HEAT PUMP

(71) Applicant: KABUSHIKI KAISHA TOYOTA CHUO KENKYUSHO, Nagakute-shi, Aichi-ken (JP)

(72) Inventors: Ko Kugimoto, Nagakute (JP); Yasuki Hirota, Nagakute (JP); Takafumi Yamauchi, Nagakute (JP); Ryuichi Iwata, Nagakute (JP)

(73) Assignee: KABUSHIKI KAISHA TOYOTA CHUO KENKYUSHO, Nagakute-shi (JP)

( * ) Notice: Subject to any disclaimer, the term of this patent is extended or adjusted under 35 U.S.C. 154(b) by 295 days.

(21) Appl. No.: 15/158,010

(22) Filed: May 18, 2016

(65) Prior Publication Data

US 2016/0341458 A1 Nov. 24, 2016

(30) Foreign Application Priority Data

May 20, 2015 (JP) ..... 2015-102580

(51) Int. Cl.
*F25B 41/00* (2006.01)
*F25B 30/00* (2006.01)
(Continued)

(52) U.S. Cl.
CPC ..... *F25B 41/00* (2013.01); *F25B 30/04* (2013.01); *F25B 39/02* (2013.01); *F25B 39/04* (2013.01); *F25B 49/043* (2013.01)

(58) Field of Classification Search
CPC ..... F25B 30/04; F25B 49/043; F25B 41/00; F25B 39/02; F25B 39/04; Y02A 30/274;
(Continued)

(56) References Cited

U.S. PATENT DOCUMENTS 4,199,959 A * 4/1980 Wurm ..... F24F 3/001 62/480
6,533,554 B1 * 3/2003 Vargo ..... F04B 19/006 417/207

(Continued)

FOREIGN PATENT DOCUMENTS

JP S59-130519 A 7/1984
JP H11-0257817 A 9/1999

(Continued)

OTHER PUBLICATIONS

Oct. 24, 2017 Office Action issued in Japanese Patent Application No. 2015-102580.

(Continued)

*Primary Examiner* — Frantz F Jules
*Assistant Examiner* — Martha Tadesse
(74) *Attorney, Agent, or Firm* — Oliff PLC

(57) ABSTRACT

A thermal transpiration flow heat pump includes an evaporator that vaporizes a medium, a condenser that condenses the medium, and a medium transport unit that is provided between the evaporator and the condenser. The medium transport unit includes a medium-temperature heat source portion that is placed on a side of the evaporator, a high-temperature heat source portion that is placed on a side of the condenser, and a thermal transpiration flow pump that is placed between the medium-temperature heat source portion and the high-temperature heat source portion.

10 Claims, 3 Drawing Sheets

(51) Int. Cl.

| | |
|---|---|
| ***F25B 39/00*** | (2006.01) |
| ***F25B 39/02*** | (2006.01) |
| ***F25B 39/04*** | (2006.01) |
| ***F25B 30/04*** | (2006.01) |
| ***F25B 49/04*** | (2006.01) |

(58) Field of Classification Search
CPC .... Y02A 30/278; Y02A 30/277; Y02B 30/62; Y02B 30/64
See application file for complete search history.

(56) References Cited

U.S. PATENT DOCUMENTS

| | | | | |
|---|---|---|---|---|
| 7,980,828 | B1 * | 7/2011 | Lantz | F04B 19/24 417/207 |
| 2004/0244356 | A1 * | 12/2004 | Ronney | F02K 9/95 60/200.1 |
| 2006/0147741 | A1 * | 7/2006 | Ho | B32B 3/10 428/544 |
| 2013/0036761 | A1 * | 2/2013 | Yonezawa | F25B 17/08 62/476 |
| 2013/0319028 | A1 * | 12/2013 | Tsubouchi | F25B 30/04 62/238.3 |
| 2014/0056722 | A1 | 2/2014 | Kugimoto et al. | |
| 2015/0159923 | A1 * | 6/2015 | Akisawa | F25B 17/08 62/324.6 |

FOREIGN PATENT DOCUMENTS

| | | |
|---|---|---|
| JP | 2014-070831 A | 4/2014 |
| JP | 2015-078645 A | 4/2015 |

OTHER PUBLICATIONS

Gupta, Naveen K. et.al., "Thermal Transpiration in Mixed Cellulose Ester Membranes: Enabling Miniature, Motionless Gas Pumps", Microporous and Mesoporous Materials, vol. 142, pp. 535-541, (2011).

Suzuki, Masahiro et. al., "Small Adsorption Refrigerating Machine Using AQSOA Adsorbent", Research Papers of Japan Society of Refrigerating and Air Conditioning Engineers, pp. 43-44, (2013).

May 29, 2018 Office Action issued in Japanese Patent Application No. 2015-102580.

* cited by examiner

THERMAL TRANSPIRATION FLOW HEAT PUMP

CROSS REFERENCE TO RELATED APPLICATION

The entire disclosure of Japanese Patent Application No. 2015-102580 filed on May 20, 2015 including specification, claims, drawings, and abstract is incorporated herein by reference in its entirety.

TECHNICAL FIELD

The present invention relates to a thermal transpiration flow heat pump which is a heat pump which uses a thermal transpiration flow.

BACKGROUND

As a heat pump which uses vaporization and condensation of a coolant using waste heat, an adsorption heat pump is known. This device employs a method in which vapor of the coolant generated in an evaporator is removed in a form of being captured on an adsorbent, and then, the adsorbent is heated to discharge the captured coolant on a condenser side to again realize a state where the vapor of the coolant can be captured. These processes are repeated to continue to absorb heat (hereinafter called "generate cold heat") at the evaporator side and to generate heat (hereinafter called "hot heat") at the condenser side.

Masahiro SUZUKI et al., "Small adsorption refrigerating machine using AQSOA® adsorbent", Research Papers of Japan Society of Refrigerating and AirConditioning Engineers, 2013 Annual Conference, Sep. 10-12, 2013, pp. 43-44 (hereinafter referred to as "Reference 1") discloses a capability of a compact adsorption refrigerating machine using the newest zeolite-based water vapor adsorbent and an installation example thereof. According to this reference, a device having an outer size of 1370 mm×1100 mm×750 mm (having a volume of $1130\times10^3$ $cm^3$) has a capability of 10 kW.

As a technique closely related to the present invention, it is known that, when a wall surface having a temperature gradient exists in dilute gas, a thermal transpiration flow in one direction along the wall surface is generated from a low-temperature portion on the wall surface toward a high-temperature portion. The dilute gas refers to gas in which, in a certain region, occurrence of collisions between gas molecules is so rare that an equilibrium state is not maintained in the region. Examples of such dilute gas include a case where a gas has a low pressure of about 1 Pa in a region of about 1 $cm^3$, a case where a pressure in a narrow region of a space of 10 nm×10 nm×10 nm is about atmospheric pressure, etc. In a region of a hole size of about 10 nm as in the latter case, the gas becomes dilute gas even at the atmospheric pressure, and the thermal transpiration flow can be generated.

For example, N. K. Gupta et al., "Thermal transpiration in mixed cellulose ester membranes; Enabling miniature, motionless gas pumps", Microporous and Mesoporous Materials, vol. 142, pp. 535-541, 2011 (hereinafter referred to as "Reference 2") discloses generation of a thermal transpiration flow under an atmospheric pressure using a porous structure membrane in which many pores having a small pore size of less than or equal to 5 times a mean free path of the medium gas are formed inside the membrane. The mean free path of the air under the atmospheric pressure is about 60 nm. In Reference 2, the medium gas on one surface side of the porous structure membrane is heated with a heater to generate a temperature difference between the one surface of the porous structure membrane and the back surface, to form a temperature gradient in the porous structure membrane, and a thermal transpiration flow is generated from the low-temperature side of the porous structure membrane to the high-temperature side.

In the adsorption heat pump of the related art, it is necessary to provide a switching in time of the cycles of heating and cooling. For this purpose, a plurality of valves and a control device or the like for manipulating the valves are required. Because the valve has a movable part and the movement thereof is controlled, care must be taken for endurance and reliability.

SUMMARY

An advantage of the present invention lies in the provision of a thermal transpiration flow heat pump having no movable part, which uses the thermal transpiration flow so that the cycle switching of heating and cooling is not necessary.

According to one aspect of the present invention, there is provided a thermal transpiration flow heat pump, comprising: an evaporator that vaporizes a medium; a condenser that condenses the medium; and a medium transport unit that is provided between the evaporator and the condenser, wherein the medium transport unit comprises: a medium-temperature heat source portion that is placed on a side of the evaporator; a high-temperature heat source portion that is placed on a side of the condenser; and a thermal transpiration flow pump that is placed between the medium-temperature heat source portion and the high-temperature heat source portion.

According to another aspect of the present invention, preferably, in the thermal transpiration flow heat pump, the thermal transpiration flow pump has a structure in which a temperature difference is provided between ends of a porous structure or porous plate having a pore size of less than or equal to 10 times a mean free path of the medium at a saturated vapor pressure, and a pressure difference is generated from a high-temperature side toward a low-temperature side.

According to another aspect of the present invention, preferably, in the thermal transpiration flow heat pump, the medium-temperature heat source portion is formed from a thermal conductive substance which is provided in direct contact with a surface of the thermal transpiration flow pump on the side of the evaporator and which has a thermal transpiration flow path of the medium extending from the evaporator toward the thermal transpiration flow pump and a medium-temperature heat source flow path which is spatially separated from the thermal transpiration flow path of the medium, and the high-temperature heat source portion is formed from a thermal conductive substance which is provided in direct contact with a surface of the thermal transpiration flow pump on the side of the condenser and which has a thermal transpiration flow path of the medium extending from the thermal transpiration flow pump toward the condenser and a high-temperature heat source flow path which is spatially separated from the thermal transpiration flow path of the medium.

According to another aspect of the present invention, preferably, in the thermal transpiration flow heat pump, a plurality of stages of the medium transport units are connected to set a predetermined value a pressure difference between a pressure on the side of the evaporator and a pressure on the side of the condenser.

According to another aspect of the present invention, preferably, in the thermal transpiration flow heat pump, on the side of the evaporator, a cold heat is output which is at a coolant temperature of a saturated vapor pressure corresponding to a reduced pressure and which is lower than a temperature of a medium-temperature heat source flow, and, on the side of the condenser, the medium is condensed in compensation of the pressure reduction on the side of the evaporator, and a hot heat is output which is at a temperature lower than a temperature of a high-temperature heat source flow and higher than the temperature of the medium-temperature heat source flow.

According to another aspect of the present invention, preferably, in the thermal transpiration flow heat pump, the medium is a substance having a saturated vapor pressure at a temperature of less than or equal to 50° C. of less than or equal to 1013 hPa, and a vaporization latent heat of greater than or equal to 10 kJ/mol.

According to another aspect of the present invention, preferably, in the thermal transpiration flow heat pump, the medium is one of water, methanol, and ethanol.

According to another aspect of the present invention, preferably, in the thermal transpiration flow heat pump, the medium-temperature heat source flow and the high-temperature heat source flow are each a liquid flow or a gas flow.

According to another aspect of the present invention, preferably, in the thermal transpiration flow heat pump, the high-temperature heat source flow is a heat source flow that continuously executes heat recovery from a waste heat source.

According to another aspect of the present invention, preferably, in the thermal transpiration flow heat pump, the medium-temperature heat source flow is connected to a heat exchanger that exchanges heat with atmospheric or in-room air.

According to another aspect of the present invention, preferably, in the thermal transpiration flow heat pump, the cold heat which is output from the evaporator is used as cold heat for air conditioning.

In the thermal transpiration flow heat pump according to the present invention, as a medium transport unit provided between an evaporator and a condenser, a structure is employed in which a thermal transpiration flow pump is provided between a medium-temperature heat source portion and a high-temperature heat source portion. The thermal transpiration flow pump is a pump which generates a thermal transpiration flow when there is a temperature difference between the sides thereof. Therefore, the thermal transpiration flow pump can continue to continuously transport the medium from the side of the evaporator to the side of the condenser without the cycle switching between heating and cooling as in the adsorption heat pump. With such a characteristic, a thermal transpiration flow heat pump without a movable part can be realized.

In the thermal transpiration flow heat pump according to the present invention, a porous structure or porous plate having a pore size of less than or equal to 10 times a mean free path of the medium at a saturated vapor pressure may be employed as the thermal transpiration flow pump. By using the porous plate having the same pore size, a selection range for the material can be widened.

In the thermal transpiration flow heat pump according to the present invention, the medium-temperature heat source portion is formed from a thermal conductive substance which directly contacts the surface of the thermal transpiration flow pump on the side of the evaporator, and the high-temperature heat source portion is formed from a thermal conductive substance which directly contacts the surface of the thermal transpiration flow pump on the side of the condenser. For example, there may be employed a structure in which the thermal transpiration flow pump is sandwiched by copper plates or the like. In these thermal conductive substances, a thermal transpiration flow path of the medium and a heat source flow path spatially separated from the thermal transpiration flow path of the medium are provided. With such a configuration, for example, the temperature difference between the respective sides of the thermal transpiration flow pump can be more effectively generated in comparison to the case of a structure which uses radiant heat conduction of non-contact type. In addition, because the thermal transpiration flow path of the medium is provided respectively in these thermal conductive substances, even when the contacting thermal conduction is employed, the thermal transpiration flow by the thermal transpiration flow pump can be realized from the evaporator side to the condenser side.

In the thermal transpiration flow heat pump according to the present invention, with one stage of the medium transport unit having the thermal transpiration flow pump, the pressure difference that can be generated is small. Therefore, a plurality of stages of the medium transport units are connected, so that a predetermined pressure difference can be obtained.

In the thermal transpiration flow heat pump according to the present invention, a cold heat of a low temperature corresponding to the reduced pressure is output at the evaporator side, and the hot heat of a high temperature is output on the side of the condenser side due to condensation of the medium in compensation of the pressure reduction at the evaporator side. With such a configuration, a heat pump without a movable part can be realized.

In the thermal transpiration flow heat pump according to the present invention, the medium is a substance having a saturated vapor pressure at a temperature of less than or equal to 50° C. of less than or equal to 1013 hPa and a vaporization latent heat of greater than or equal to 10 kJ/mol. For example, as water satisfies these conditions, no special medium is required.

In the thermal transpiration flow heat pump according to the present invention, the medium is one of water, methanol, and ethanol. Thus, no special medium is required.

In the thermal transpiration flow heat pump according to the present invention, the medium-temperature heat source flow and the high-temperature heat source flow are each a liquid flow or a gas flow. Therefore, the heat source flow can be easily continuously realized.

In the thermal transpiration flow heat pump according to the present invention, the high-temperature heat source flow is a heat source flow which continuously executes heat recovery from a waste heat source. With such a configuration, the waste heat which is at a higher temperature than room temperature can be used without the use of a special high heat generation device, and thus, the device is economical.

In the thermal transpiration flow heat pump according to the present invention, the medium-temperature heat source flow is connected to a heat exchanger which exchanges heat with the atmospheric or the in-room air. Therefore, warm atmospheric or in-room air can be used as the heat source flow without the use of a special heat source for the medium-temperature heat source flow.

In the thermal transpiration flow heat pump according to the present invention, the cold heat which is output from the evaporator is used as the cold heat for air conditioning. In this manner, the heat pump may be used in a manner to execute warming with the hot heat on the side of the condenser and cooling with the cold heat on the evaporator side.

BRIEF DESCRIPTION OF DRAWINGS

Embodiment(s) of the present disclosure will be described by reference to the following figures, wherein.

DESCRIPTION OF EMBODIMENTS

Figure 1:
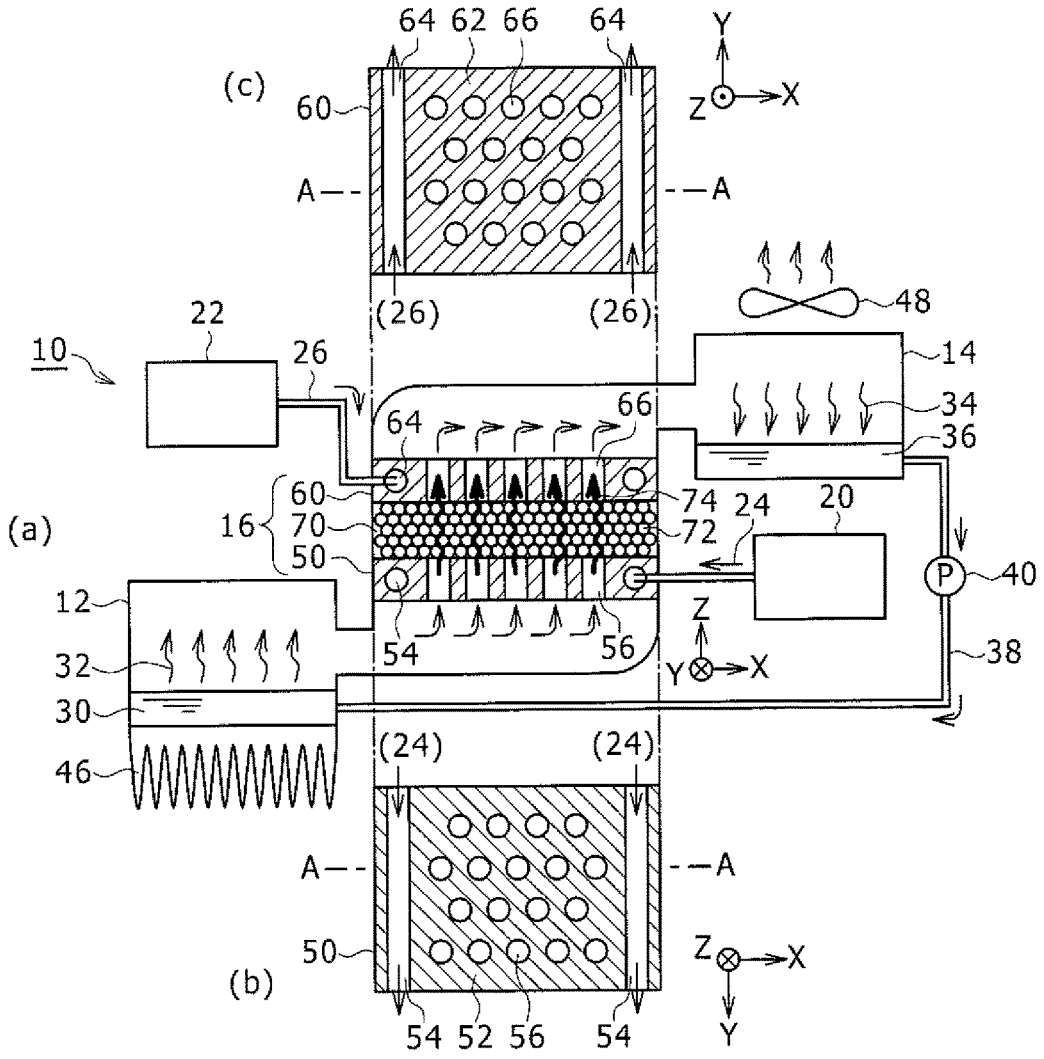
FIG. 1 is a structural diagram of a thermal transpiration flow heat pump according to a preferred embodiment of the present invention, with FIG. 1(*a*) being an overall structural diagram, FIG. 1(*b*) being a cross-sectional diagram of a medium-temperature heat source portion, and FIG. 1(*c*) being a cross-sectional diagram of a high-temperature heat source portion.

A preferred embodiment of the present invention will now be described in detail with reference to the drawings. A size, a shape, a material, a pressure, a pore size, and a connection number of thermal transpiration flow pumps, etc., described below are exemplary for the purpose of explanation, and may be suitably changed according to the specification of a thermal transpiration flow heat pump. In the following, a same reference numeral is assigned to similar elements over the drawings, and repeating description will not be given.

FIG. 1 is a structural diagram of a thermal transpiration flow heat pump 10. FIG. 1(*a*) is an overall structural diagram of the thermal transpiration flow heat pump 10. The thermal transpiration flow heat pump 10 is a heat pump which uses a thermal transpiration flow pump 70 as a transporting means of a medium.

The thermal transpiration flow heat pump 10 includes an evaporator 12, a condenser 14, and a medium transport unit 16. The thermal transpiration flow heat pump 10 further includes a medium-temperature heat source 20 and a high-temperature heat source 22. The medium transport unit 16 includes a medium-temperature heat source portion 50, a high-temperature heat source portion 60, and a thermal transpiration flow pump 70. FIG. 1(*a*) shows a cross-sectional diagram of the evaporator 12, the condenser 14, and the medium transport unit 16, with the scale of the portions of the medium transport unit 16 being enlarged compared to the other constituting elements. FIG. 1(*a*) shows XYZ directions as three orthogonal directions. The X direction is a direction from the evaporator 12 toward the condenser 14, the Y direction is a direction from a front side of the page toward the back side of the page, and the Z direction is a direction in which the medium flows in the medium transport unit 16.

FIG. 1(*b*) is a diagram of the medium-temperature heat source portion 50 viewed from a bottom surface side which is the −Z side of the medium transport unit 16, and FIG. 1(*c*) is a diagram of the high-temperature heat source portion 60 viewed from the upper surface side which is the +Z side of the medium transport unit 16. A cross-sectional diagram of the medium transport unit 16 along an A-A line in FIGS. 1(*b*) and 1(*c*) corresponds to FIG. 1(*a*).

The evaporator 12 is a container in which a medium 30 of a liquid phase is stored on a bottom surface side, and an internal pressure of the evaporator 12 is reduced to vaporize the liquid-phase medium 30 to a gas-phase medium 32. The pressure reduction is executed by a function of the thermal transpiration flow pump 70 of the medium transport unit 16. A fin 46 provided on an outer circumferential wall of the evaporator 12 is a heat discharge fin for exchanging heat between the evaporator 12 and an outer atmosphere or in-room air. In the evaporator 12, a cold heat is generated by vaporization latent heat when the liquid-phase medium 30 is vaporized and becomes the gas-phase medium 32. With the generated cold heat, the outer atmosphere or the in-room air is cooled via the fin 46. In this manner, the cold heat generated in the evaporator 12 can be used as the cold heat for air conditioning.

The condenser 14 is a container in which a gas-phase medium 34 is condensed to a liquid-phase medium 36 by pressurization of the internal pressure and which stores the liquid-phase medium 36 at a bottom surface. The pressurization is executed by a function of the thermal transpiration flow pump 70 of the medium transport unit 16. A radiator fan 48 provided on an outer wall side of the condenser 14 is a heat discharge fan that exchanges heat between the condenser 14 and the outer atmosphere or the in-room air. In the condenser 14, condensation heat is discharged and a hot heat is generated in the same amount as the vaporization latent heat at the evaporator 12 when the gas-phase medium 34 is condensed and becomes the liquid-phase medium 36. With the generated hot heat, the outer atmosphere or the in-room air is warmed via the radiator fan 48. In this manner, the hot heat generated in the condenser 14 can be used as hot heat for warming.

A medium flow path 38 is a flow path in which the liquid-phase medium 36 stored on the bottom surface of the condenser 14 is returned to the bottom surface of the evaporator 12. A medium circulation pump 40 is a pump which is provided on the medium flow path 38, and which circulates the coolant between the condenser 14 and the evaporator 12.

As the medium, there may be used a fluid which is gasified by pressure reduction and which is condensed by pressurization. Preferably, the medium is a substance having a saturated vapor pressure at a temperature of less than or equal to 50° C. of less than or equal to 1013 hPa and a vaporization latent heat of greater than or equal to 10 kJ/mol. As such a medium, one of water, methanol, and ethanol may be used. In addition to these, for example, $NH_3$ or the like may be used as the medium.

The medium transport unit 16 is a medium transporting device having no movable part, which is provided between the evaporator 12 and the condenser 14, and which converts the pressure-reduced, gas-phase medium 32 at the evaporator 12 into gas-phase medium 34 under high pressure and continuously transports to the condenser 14. The medium transport unit 16 has a structure in which the thermal transpiration flow pump 70 is sandwiched between the medium-temperature heat source portion 50 and the high-temperature heat source portion 60.

The medium-temperature heat source portion 50 is a portion in which a medium-temperature heat source flow path 54 and a thermal transpiration flow path 56 of the medium are provided in a plate member 52 formed from a thermal conductive substance. FIG. 1(*b*) shows a plan view of the medium-temperature heat source portion 50. The medium-temperature heat source flow path 54 is a flow path through which a medium-temperature heat source flow 24 supplied from the medium-temperature heat source 20 flows. The medium-temperature heat source flow path 54 is provided in a direction parallel to the Y direction. As the thermal conductive substance, a substance having a thermal conductivity in a range from 10 W/m/K to 1000 W/m/K is preferably used. For example, copper, aluminum, stainless steel, or the like may be used.

The medium-temperature heat source 20 is cooling water having a temperature near room temperature. In FIG. 1(*a*), a cooling water tank is shown as the medium-temperature heat source 20. A heat exchanger may be provided on a cooling water tank or the like, so that heat can be exchanged between the atmosphere or the in-room air and the cooling water and the temperature of the cooling water can be set at approximately the same temperature as the atmospheric temperature or the in-room air temperature. The medium-temperature heat source flow 24 is a cooling water flow. With such a configuration, the medium-temperature heat source portion 50 becomes a heat source having the temperature of the cooling water which is the medium-temperature heat source 20. Alternatively, as the medium-temperature heat source flow 24, other medium-temperature liquid flow or medium-temperature gas flow may be employed in place of the cooling water flow.

The high-temperature heat source portion 60 is a portion in which a high-temperature heat source flow path 64 and a thermal transpiration flow path 66 of the medium are provided in a plate member 62 formed from a thermal conductive substance. FIG. 1(*c*) shows a plan view of the high-temperature heat source portion 60. The high-temperature heat source flow path 64 is a flow path in which a high-temperature heat source flow 26 supplied from the high-temperature heat source 22 flows. The high-temperature heat source flow path 64 is provided in a direction parallel to the Y direction.

The high-temperature heat source 22 is a heat generating structure having a significantly higher temperature than room temperature. As the high-temperature heat source 22, there may be used a waste heat source of a heat generating device or the like such as a rotary electric machine and an engine. For the high-temperature heat source flow 26, the heat flow from the waste heat source can be used without any processing. Here, high-temperature air of a high-temperature atmosphere of the waste heat source is used as the high-temperature gas flow and the high-temperature heat source flow 26. With such a configuration, the high-temperature heat source flow 26 may be set as a heat source flow which continuously executes heat recovery from the waste heat source, and the high-temperature heat source portion 60 is a heat source having a temperature of the high-temperature gas which is the high-temperature heat source 22. Alternatively, as the high-temperature heat source flow 26, other high-temperature gas flow or high-temperature liquid flow may be used in place of the high-temperature gas flow.

Before the thermal transpiration flow paths 56 and 66 of the medium are described, the thermal transpiration flow pump 70 will be described. The thermal transpiration flow pump 70 is formed from a porous structure membrane. A porous structure membrane is a pore structure membrane having pores 72, and a porous membrane having a plurality of pores 72 in a predetermined porosity may be used. The pore 72 has a pore size of less than or equal to 10 times a mean free path of the medium at the saturated vapor pressure. The porous structure membrane is formed from a material having a low thermal conductivity. A thermal conductivity of less than or equal to 0.2 W/(m-K) is preferable. The porosity of the pores 72 in the porous structure membrane can be evaluated, for example, by volume occupancy of the pore portion. As an example, the porosity is about 90%. Alternatively, the porous structure membrane may have other porosities. As the porous structure membrane having such a characteristic, Aerogel (substance name) in which silica which is silicon dioxide ($SiO_2$) is made porous may be used. Alternatively, a porous structure plate having a uniform pore size may be used.

In the porous structure membrane, when there is a temperature difference between an end surface on one side and an end surface on the other side, a thermal transpiration flow 74 is generated from the end surface of a low-temperature side toward the end surface of a high-temperature side. In the medium transport unit 16, the medium-temperature heat source portion 50 is placed on the end surface of the thermal transpiration flow pump 70 which is a porous structure membrane on the side of the evaporator 12, and the high-temperature heat source portion 60 is placed on the end surface on the side of the condenser 14. The medium-temperature heat source portion 50 is approximately at atmospheric temperature or the in-room air temperature, and the temperature of the high-temperature heat source portion 60 is significantly higher in comparison. Therefore, the end surface of the thermal transpiration flow pump 70 which is the porous structure membrane on the side of the evaporator 12 becomes the low-temperature side, the end surface on the side of the condenser 14 becomes the high-temperature side, and the thermal transpiration flow 74 is generated from the medium-temperature heat source portion 50 which is the low-temperature side end surface of the thermal transpiration flow pump 70 which is the porous structure membrane toward the high-temperature heat source portion 60 which is the high-temperature side end portion. With such a configuration, the gas-phase medium 32 at the evaporator 12 which is the low-temperature side space is suctioned from the side of the medium-temperature heat source portion 50 of the thermal transpiration flow pump 70, passes through the pore 72 and to the side of the high-temperature heat source portion 60, and flows to the condenser 14 which is the high-temperature side space. Therefore, the pressure of the evaporator 12 which is the low-temperature side space is reduced and the condenser 14 which is the high-temperature side space is pressurized.

The generation of the thermal transpiration flow 74 at the thermal transpiration flow pump 70 is affected by a temperature difference between a temperature of an interface between the thermal transpiration flow pump 70 and the medium-temperature heat source portion 50 and a temperature of an interface between the thermal transpiration flow pump 70 and the high-temperature heat source portion 60. As the temperature difference becomes larger, generation of the thermal transpiration flow 74 is increased. Thus, the medium-temperature heat source portion 50 is placed in direct contact with a surface of the thermal transpiration flow pump 70 on the side of the evaporator, and the high-temperature heat source portion 60 is placed in direct contact with a surface of the thermal transpiration flow pump 70 on the side of the condenser. The "placement with direct contact" includes placement with a close contact and bonding with an adhesive or the like having a superior thermal conductivity. By placing the portions in direct contact, the heat of the medium-temperature heat source flow 24 and the high-temperature heat source flow 26 can be more effectively conducted to the surfaces on respective sides of the thermal transpiration flow pump 70 as compared to the case of a configuration where the surface of the thermal transpiration flow pump 70 on the side of the evaporator is cooled and the surface of the thermal transpiration flow pump 70 on the side of the condenser 14 is heated. Thus, the temperature difference between the sides of the thermal transpiration flow pump can be efficiently generated.

For the medium-temperature heat source portion 50 and the high-temperature heat source portion 60, the plate members 52 and 62 each formed from a thermal conductive substance are respectively used. As the plate members 52 and 62, a metal having a high thermal conductivity is preferably used. As the metal having high thermal conductivity, a metal having a thermal conductivity in a range from 10 W/m/K to 1000 W/m/K is preferably used. For example, copper, aluminum, stainless steel, or the like may be used as the plate members 52 and 62.

When the plate member 52 made of a metal which is the medium-temperature heat source portion 50 is in direct contact with the surface of the thermal transpiration flow pump 70 on the evaporator side, the gas-phase medium 32 of the evaporator 12 is blocked by the metal plate member 52 and does not reach the surface of the thermal transpiration flow pump 70 on the evaporator side. Thus, the thermal transpiration flow path 56 of the medium is provided in the medium-temperature heat source portion 50. The thermal transpiration flow path 56 of the medium is a flow path extending from the evaporator 12 toward the thermal transpiration flow pump 70, and in which the gas-phase medium 32 corresponding to the thermal transpiration flow 74 flows. The thermal transpiration flow path 56 of the medium is provided spatially separated from the medium-temperature heat source flow path 54 in which the cooling water flows. In the example configuration shown in FIG. 1(*b*), the medium-temperature heat source flow path 54 is a flow path in the Y direction, the thermal transpiration flow path 56 of the medium is a flow path in the Z direction, and the flow paths are placed so as not to intersect each other. This configuration is merely one example of the placement, and alternatively, other placement methods may be employed so long as the flow paths do not intersect each other.

Similarly, the thermal transpiration flow path 66 of the medium is provided in the high-temperature heat source portion 60. The thermal transpiration flow path 66 of the medium is a flow path extending from the thermal transpiration flow pump 70 toward the condenser 14, and in which the gas-phase medium 34 corresponding to the thermal transpiration flow 74 flows. The thermal transpiration flow path 66 of the medium is provided spatially separated from the high-temperature heat source flow path 64 in which the high-temperature heat source flow 26 flows. In the example configuration of FIG. 1(*c*), the high-temperature heat source flow path 64 is a flow path in the Y direction, the thermal transpiration flow path 66 of the medium is a flow path in the Z direction, and the flow paths are placed in a manner so as not to intersect each other. This configuration is merely an example of the placement, and alternatively, other placement methods may be employed so long as the paths do not intersect each other.

An example size of the medium transport unit 16 having the above-described structure will now be described. The medium-temperature heat source portion 50 and the high-temperature heat source portion 60 basically have the same size, and thicknesses thereof along the Z direction are about 0.3 mm. A thickness along the Z direction of the thermal transpiration flow pump 70 is about 0.4 mm. Therefore, a total thickness along the Z direction of the layered structure of the medium-temperature heat source portion 50, the thermal transpiration flow pump 70, and the high-temperature heat source portion 60 is about 1.0 mm. For the medium transport unit 16, a flow path for transporting the gas-phase medium 32 of the evaporator 12 is required on the evaporator 12 side of the medium-temperature heat source portion 50, and, similarly, a flow path for transporting the gas-phase medium 34 is required on the condenser 14 side of the high-temperature heat source portion 60. Based on this, the thickness necessary for the medium transport unit 16 as a whole may be considered to be about 1.2 mm.

A diameter of the medium-temperature heat source flow path 54 in the medium-temperature heat source portion 54 and a diameter of the high-temperature heat source flow path 64 in the high-temperature heat source portion 60 are each about 0.3 mm, and a diameter of the thermal transpiration flow path 56 of the medium in the medium-temperature heat source portion 50 and a diameter of the thermal transpiration flow path 66 of the medium in the high-temperature heat source portion 60 are each about 0.3 mm. These sizes are merely exemplary for the purpose of explanation, and alternatively, other sizes may be employed.

According to the thermal transpiration flow heat pump 10 having the above-described structure, there can be realized a heat pump in which the cold heat generated in the evaporator 12 is used as the cold heat for in-room air conditioning, and the hot heat generated in the condenser 14 is used as the hot heat for in-room warming. The temperature relationship in each part will now be summarized. A temperature θ1 of the medium-temperature heat source 20 is lower than a temperature θ3 of the high-temperature heat source 22. A temperature θ0 of the cold heat generated in the evaporator 12 is lower than the temperature θ1. A temperature θ2 of the hot heat generated in the condenser 14 is lower than the temperature θ3 and higher than the temperature θ0. As an example, the temperature θ0 is about 15° C., which is the temperature of the in-room air conditioning, and the temperature θ2 is about 25° C., which is the temperature of the in-room warming. The temperature θ1 is about room temperature, is about 30° C. when the room is cooled, and is about 5° C. when the room is warmed. The temperature θ3 is the temperature of the waste heat of a rotary electric machine or an engine, and is about 100° C.

An application example of the thermal transpiration flow heat pump 10 having the above-described structure for an air-conditioning device was subjected to a trial calculation. The trial calculation was executed in comparison to the characteristic of the compact adsorption refrigerating machine disclosed in Reference 1. The compact adsorption refrigerating machine of Reference 1 realizes a capability of 10 kW with one device of a volume of $1130\times10^3$ $cm^3$.

As a target capability, a floor area of the in-room space of a vehicle was set at about 20 $m^2$, an operation temperature range was set at 15-30° C., and the power was set at 2.4 kW.

In an example result of the trial calculation, the necessary pump capability can be realized by setting the pressure of the evaporator 12 at 2 kPa, the pressure of the condenser 14 at 4 kPa, and the flow rate at 1 g/s. In order to secure this flow rate, the flow path area of the medium transport unit 16 described with reference to FIG. 1 must be increased, and, in order to secure the pressure difference, a plurality of stages of units must be connected in series.

Figure 2:
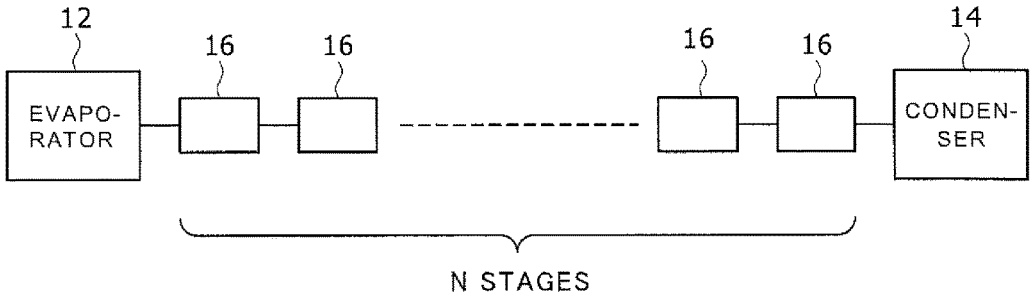
FIG. 2 is a diagram showing an example configuration of connecting a plurality of stages of medium transport units in a thermal transpiration flow heat pump according to a preferred embodiment of the present invention.
Figure 3A:
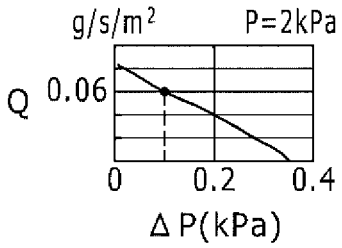
FIG. 3A is a diagram showing that a (pressure difference-flow rate) characteristic of a medium transport unit differs depending on a medium pressure value in a thermal transpiration flow heat pump according to a preferred embodiment of the present invention, and is a characteristic diagram of an evaporator side having a low medium pressure value.
Figure 3B:
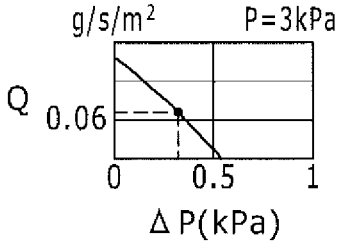
FIG. 3B is a diagram showing that a (pressure difference-flow rate) characteristic of a medium transport unit differs depending on a medium pressure value in a thermal transpiration flow heat pump according to a preferred embodiment of the present invention, and is a characteristic diagram at an intermediate medium pressure value.
Figure 3C:
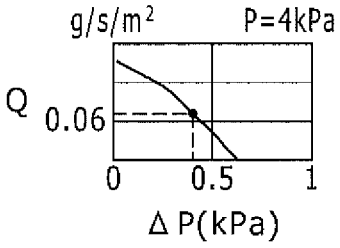
FIG. 3C is a diagram showing that a (pressure difference-flow rate) characteristic of a medium transport unit differs depending on a medium pressure value in a thermal transpiration flow heat pump according to a preferred embodiment of the present invention, and is a characteristic diagram of a condenser side having a high medium pressure value.

FIG. 2 shows a model diagram of placement of N stages of the medium transport units 16 between the evaporator 12 (having the pressure of 2 kPa) and the condenser 14 (having the pressure of 4 kPa). A (pressure difference-flow rate) characteristic of the thermal transpiration flow pump 70 changes according to the pressure value of the medium. As the pressure value of the medium is reduced, the flow rate is reduced even for the same pressure difference. FIGS. 3A, 3B, and 3C show the change of the (pressure difference-flow rate) characteristic of the thermal transpiration flow pump 70 with a change of the pressure value of the medium. Horizontal axes of FIGS. 3A, 3B, and 3C show the pressure difference and vertical axes show the flow rate of the thermal transpiration flow per unit area.

FIGS. 3A, 3B, and 3C are characteristic diagrams when the temperature θ3 is about 220° C. and the temperature θ1 is about 20° C. FIG. 3A shows the (pressure difference-flow rate) characteristic of the thermal transpiration flow pump 70 at the pressure value of the evaporator 12 of 2 kPa, FIG. 3C shows the (pressure difference-flow rate) characteristic of the thermal transpiration flow pump 70 at the pressure of the condenser 14 of 4 kPa, and FIG. 3B shows the (pressure difference-flow rate) characteristic of the thermal transpiration flow pump 70 at 3 kPa, which is an intermediate pressure between those of FIGS. 3A and 3C.

Based on these diagrams, for example, when the flow rate Q per unit area is 0.06 $g/s/m^2$, it can be understood that a pressure difference of about 0.1 kPa is generated with the pressure of 2 kPa at the evaporator and a pressure difference of about 0.4 kPa is generated at the pressure of 4 kPa of the condenser 14. A pressure difference of about 0.3 kPa is generated at the intermediate pressure of 3 kPa. Based on calculation of such data, it was found that, in order to set the pressure of the evaporator 12 at 2 kPa and the pressure of the condenser 14 at 4 kPa, N should be 8; that is, 8 stages of the medium transport units 16 must be connected in series. The basis of the calculation is the flow rate Q per unit area of 0.06 $g/s/m^2$. In order to achieve the target characteristic flow rate of 1 g/s, as $\{(1\ g/s)/(0.06\ g/s/m^2)\}$=about 17, the flow path area of the medium transport unit 16 of each stage must be about 17 $m^2$.

Therefore, in order to obtain the power of 2.4 kW, a volume of $\{8\ \text{stages}\times(\text{area of } 17\ m^2)\times(\text{thickness of } 1.2\ mm)\}$ is required for the medium transport unit 16. The necessary volume is $163\times10^3\ cm^3$. In the compact adsorption refrigerating machine of Reference 1, the volume corresponding to the power of 2.4 kW is $\{1130\times10^3\ cm^3\}\times0.24=272\times10^3\ cm^3$. Thus, with the thermal transpiration flow heat pump 10 of the above-described structure, the size can be reduced by about 60% in volume as compared to the compact adsorption refrigerating machine of Reference 1. Furthermore, movable parts such as a valve and a control device thereof are not necessary, and, consequently, the reliability can be improved. The (pressure difference-flow rate) characteristic shown in FIGS. 3A, 3B, and 3C change according to conditions such as the heating method, the thickness of the porous structure, and the pore size, and may be further improved. If these characteristics are improved, the size of the device can be further reduced according to the improvement.

As shown in FIGS. 3A, 3B, and 3C, the pressure difference generated on the ends of the thermal transpiration pump 70 is at most about 1 kPa, and is small compared to the case when the pump is driven under the atmospheric pressure. Therefore, breakage of the thermal transpiration flow pump 70 due to the pressure difference is suppressed. In addition, because the thermal transpiration flow pump 70 is placed between the evaporator 12 and the condenser 14 and is isolated from the outside of the device, occurrence of clogging of the pores 72 due to floating particulates or the like can be suppressed. The upper limit of the size of the pore is set to less than or equal to 10 times the mean free path at the saturated vapor pressure, but the lower limit may be any value in the range which can be industrially manufactured so long as there is no restriction such as clogging.

The invention claimed is:

1. A thermal transpiration flow heat pump, comprising:

an evaporator;

a condenser;

a medium flow path for circulating to the evaporator a medium, which has been condensed by the condenser to a liquid phase; and a medium transport unit that is provided between the evaporator and the condenser, wherein:

the medium transport unit comprises:

a medium-temperature heat source portion that is placed on a side of the evaporator and comprises a medium-temperature heat source flow path through which a medium-temperature heat source flow flows;

a high-temperature heat source portion that is placed on a side of the condenser and comprises a high-temperature heat source flow path through which a high-temperature heat source flow flows; and a thermal transpiration flow pump that (i) is placed between the medium-temperature heat source portion and the high-temperature heat source portion, (ii) has a pore size of less than or equal to 10 times a mean free path of the medium at a saturated vapor pressure, and (iii) generates a thermal transpiration flow of the medium from the side of the evaporator to the side of the condenser by a temperature difference between a medium temperature of the medium-temperature heat source flow on the side of the evaporator and a high temperature of the high-temperature heat source flow on the side of the condenser;

the evaporator (i) stores the medium circulated through the medium flow path in the liquid phase and (ii) causes, when an internal pressure of the evaporator is reduced by the medium transport unit, the medium in the liquid phase to be vaporized to a gas phase whose saturated vapor pressure equals the reduced internal pressure; and the condenser (i) causes, when an internal pressure of the condenser is increased by the medium transport unit, the medium in the gas phase transported from the side of the evaporator to be condensed to the liquid phase at a saturated vapor pressure equal to the increased internal pressure and (ii) stores the medium condensed to the liquid phase.

2. The thermal transpiration flow heat pump according to claim 1, wherein the thermal transpiration flow pump has a structure in which a temperature difference is provided between ends of a porous structure or porous plate, and a pressure difference is generated from a high-temperature side toward a low-temperature side.

3. The thermal transpiration flow heat pump according to claim 1, wherein (i) the medium-temperature heat source portion is formed from a thermal conductive substance which is provided in direct contact with a surface of the thermal transpiration flow pump on the side of the evaporator, (ii) the medium-temperature heat source portion has a thermal transpiration flow path of the medium extending from the evaporator toward the thermal transpiration flow pump, and (iii) the medium-temperature heat source flow path is spatially separated from the thermal transpiration flow path of the medium, and (i) the high-temperature heat source portion is formed from a thermal conductive substance which is provided in direct contact with a surface of the thermal transpiration flow pump on the side of the condenser, (ii) the high-temperature heat source portion has a thermal transpiration flow path of the medium extending from the thermal transpiration flow pump toward the condenser, and (iii) the high-temperature heat source flow path is spatially separated from the thermal transpiration flow path of the medium.

4. The thermal transpiration flow heat pump according to claim 2, wherein a plurality of stages of the medium transport unit are connected to set a predetermined value of a pressure difference between a pressure on the side of the evaporator and a pressure on the side of the condenser.

5. The thermal transpiration flow heat pump according to claim 3, wherein on the side of the evaporator, a cold heat is output which is at a coolant temperature of the saturated vapor pressure corresponding to the reduced internal pressure and which is lower than the medium temperature of the medium-temperature heat source flow; and on the side of the condenser, the medium is condensed in compensation of the pressure reduction on the side of the evaporator, and a hot heat is output which is at a temperature lower than the high temperature of the high-temperature heat source flow and higher than the medium temperature of the medium-temperature heat source flow.

6. The thermal transpiration flow heat pump according to claim 1, wherein the medium is a substance having a saturated vapor pressure at a temperature of less than or equal to 50° C. of less than or equal to 1013 hPa, and a vaporization latent heat of greater than or equal to 10 kJ/mol.

7. The thermal transpiration flow heat pump according to claim 6, wherein the medium is one of water, methanol, and ethanol.

8. The thermal transpiration flow heat pump according to claim 3, wherein the medium-temperature heat source flow and the high-temperature heat source flow are each a liquid flow or a gas flow.

9. The thermal transpiration flow heat pump according to claim 8, wherein the high-temperature heat source flow is a heat source flow that continuously executes heat recovery from a waste heat source.

10. The thermal transpiration flow heat pump according to claim 5, wherein the cold heat which is output from the evaporator is used as cold heat for air conditioning.

* * * * *